US005979410A

United States Patent [19]

Grieshaber

[11] Patent Number: 5,979,410

[45] Date of Patent: Nov. 9, 1999

[54] FUEL INJECTION SYSTEM FOR AN INTERNAL COMBUSTION ENGINE

[75] Inventor: Hermann Grieshaber, Aichtal, Germany

[73] Assignee: Robert Bosch GmbH, Stuttgart, Germany

[21] Appl. No.: 09/137,817

[22] Filed: Aug. 21, 1998

[30] Foreign Application Priority Data

Sep. 3, 1997 [DE] Germany ..... 197 38 397

[51] Int. Cl.[6] ..... F02M 37/04

[52] U.S. Cl. ..... 123/467; 123/575; 123/300

[58] Field of Search ..... 123/575, 576, 123/577, 578, 299, 300, 467, 456

[56] References Cited

U.S. PATENT DOCUMENTS

| | | | |
|---|---|---|---|
| 2,984,229 | 5/1961 | Vaughan | 123/577 |
| 3,807,377 | 4/1974 | Hirschler | 123/575 |
| 3,908,794 | 9/1975 | Bailey | 123/577 |
| 4,505,244 | 3/1985 | Smith | 123/575 |
| 4,705,010 | 11/1987 | Baranescu | 123/300 |
| 4,911,116 | 3/1990 | Prohaska | 123/576 |
| 5,194,247 | 3/1993 | Tosa | 123/575 |
| 5,438,966 | 8/1995 | Teegan | 123/299 |
| 5,647,316 | 7/1997 | Hellen | 123/299 |
| 5,651,346 | 7/1997 | Remmels et al. . | |
| 5,722,377 | 3/1998 | Schoenfeld | 123/575 |
| 5,862,793 | 1/1999 | Jay | 123/467 |

FOREIGN PATENT DOCUMENTS

| | | |
|---|---|---|
| 4341739 | 3/1995 | Germany . |
| 4337048 | 5/1995 | Germany . |

*Primary Examiner*—Carl S. Miller
*Attorney, Agent, or Firm*—Edwin E. Greigg; Ronald E. Greigg

[57] ABSTRACT

A fuel injection system with an injector for an internal combustion engine has a binary injection nozzle whose pressure chamber can be alternatingly supplied with fuel and a supplemental fluid. A valve device is provided which can control the high-pressure side fuel delivery to the binary injection nozzle and the connection of the pressure chamber to a low-pressure side and to a supply line of the supplemental fluid. The valve device has a reversing valve that is embodied for controlling the impingement of high or low pressure on the pressure chamber and is also embodied for controlling the filling of the pressure chamber with the supplemental fluid. Therefore, the valve device is improved with regard to more rapid and precise switching operations and is also simplified, resulting in greater reliability and reduced maintenance.

6 Claims, 2 Drawing Sheets

FUEL INJECTION SYSTEM FOR AN INTERNAL COMBUSTION ENGINE

BACKGROUND OF THE INVENTION

The invention is directed to improvements in a fuel injection system for internal combustion engines.

In a fuel injection system of this kind, which has been disclosed by DE 43 37 048 C2, a high-pressure delivery pump supplies a high-pressure reservoir with fuel from a storage tank. Pressure lines lead from the (common rail) high-pressure reservoir to the individual injection nozzles of the internal combustion engine. The nitrogen oxide and soot emissions of the engine are reduced by means of an injection of fuel (diesel fuel) and a supplemental fluid, which can be carried out in succession. This type of injection effects a reduction in fuel consumption. As a rule, water is used as the supplemental fluid.

In a low load operation of the engine or when the engine is cold, however, the water injection portion must be dynamically and rapidly reduced or shut off. Otherwise the HC emissions increase.

In a common rail system, the high injection pressure continuously prevails in the injection nozzle. As a result, in the known fuel injection system, the provision is made that the pressure inside the pressure chamber is temporarily reduced in order to facilitate the pre-storing of supplemental fluid in the pressure chamber. This is carried out by means of a 3/2-way valve so that fuel can be displaced from the pressure chamber by means of the incoming supplemental fluid. In the injection pause, the 3/2-way valve opens the passage to a discharge line for the pressure reduction and the return of the fuel from the injection nozzle to a reservoir. At the same time, the inlet from the common rail pressure reservoir is closed off. Parallel to this valve control, an opening for the inlet of the supplemental fluid (water) is unblocked by means of another check valve. The supplemental fluid is supplied to the injection nozzle in the region of the nozzle tip. The check valve is held in an open position until the desired quantity of supplemental fluid has been pre-stored in the pressure chamber.

If the check valve is closed again, the 3/2-way valve is switched over again into the injection position for fuel. Then fuel can once again arrive in the pressure chamber at high pressure. The connection to the common rail pressure reservoir is thereby continuously reestablished. The storage of fuel and supplemental fluid in the pressure chamber occurs in layers. When supplemental fluid is pre-stored in the pressure chamber, a residue of fuel nevertheless remains beneath the inlet opening for the supplemental fluid. After being let in, the supplemental fluid forms a layer over the fuel. Then, fuel is once again supplied to the pressure chamber, which settles down over the supplemental fluid layer. Consequently, a small quantity of pure fuel is injected first at the beginning of the injection. For this reason, a short ignition delay occurs. Then all of the stored supplemental fluid is injected. The metering of the supplemental fluid through the control of the valve device must be carried out so that no residual supplemental fluid remains in the pressure chamber. At loads from zero to approx. 20% (max. 40%) full load, the storage of supplemental fluid is switched off and pure fuel is injected. At loads below approx. 20% and in engines that have not yet reached normal operation temperature, no supplemental fluid is pre-stored.

The admixture of fuel and supplemental fluid in the pressure chamber requires a precise and rapid control of the valve device. For example, depending on the operating state of the engine, the quantity of fuel or supplemental fluid must be able to be varied from work cycle to work cycle.

Two reversing valves that are separate from each other are provided in the known fuel injection system, for the filling of fuel and supplemental fluid into the pressure chamber. The reversing valve for the fuel storage is embodied as a 3/2-way valve, while in addition, a separate check valve is required for storing supplemental fluid in the pressure chamber.

The two valves must be coordinated with each other and controlled interdependently for an alternating filling of the pressure chamber. This requires additional control devices. The tuning of the valve control by means of the development of costly electronics therefore makes the fuel injection system more expensive and has a disadvantageous effect on the effort and costs associated with maintenance.

The use of the complexly designed fuel injection system, which is comprised of a number of individual components, increases the susceptibility to malfunction.

OBJECT AND SUMMARY OF THE INVENTION

The principal object of the invention is to improve and simplify the valve control for fuel and supplemental fluid. To achieve this object, the fuel injection system according to the invention has a reversing valve for controlling pressure in the pressure chamber and filling thereof with supplemental fluid.

This fuel injection system has only a single reversing valve in order to be able to switch between the fluid lines for fuel and supplemental fluid or for a pressure relief of the pressure chamber. Through the operation of a single valve as a control valve, rapid changes can be carried out in the storing of fuel or supplemental fluid in the pressure chamber. The valve device can be more precisely and rapidly switched through the control of a single valve.

It is another object of the invention to reduce the number of components in the valve device of the fuel injection system, providing the additional advantage that in the maintenance of the fuel injection system, only the operation of one valve has to be controlled and possibly overhauled and not a large number of separate valves. It must be taken into account here that in an internal combustion system, there can be a large number of injection nozzles. The reduction in the number of components also has a positive effect on a possible malfunction susceptibility of the valve device, since the danger source is reduced by a number of complexly embodied and susceptible components.

Known technologies can be relied on for the reversing valve. In particular, a 2/2-solenoid valve can be used. For example, a 2/2-way valve of this kind can either unblock the two openings to relieve the pressure in the pressure chamber, or can unblock the opening to the common rail high-pressure reservoir.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
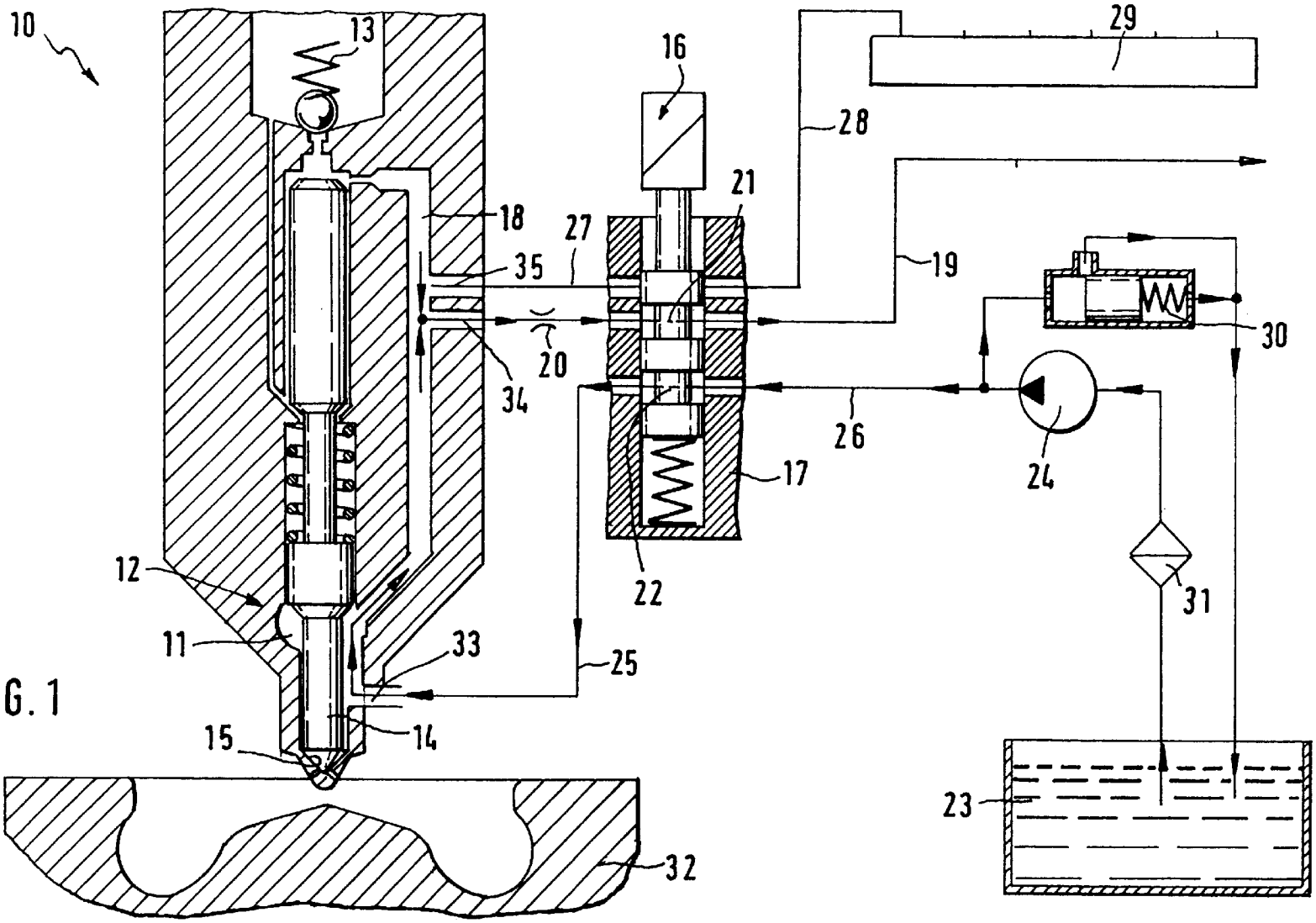
FIG. 1 is a schematic representation of an exemplary embodiment in which supplemental fluid is stored in the pressure chamber of the injection nozzle by way of the reversing valve according to the invention and FIG. 2 shows the state of the exemplary embodiment according to FIG. 1, in which the supply line for supplemental fluid is closed and fuel is conveyed into the pressure chamber.

The exemplary embodiment of a fuel injection system with an injector 10 according to FIG. 1 is disposed in a state in which the supplemental fluid is being stored in a pressure chamber 11 of a binary injection nozzle 12.

By closing a solenoid valve 13, a nozzle needle 14 is pressed against a valve seat 15 by the pressure of a spring. Consequently, neither fuel nor supplemental fluid can be injected from the binary injection nozzle 12.

The pressure chamber 11 and a supply line 18 for supply of fuel to the binary injection nozzle 12 are largely pressure relieved due to the position of a reversing valve 16 with a valve housing 17. The supply line 18 communicates with a fuel container by way of a return line 19. A de-coupling throttle is built into the return line 19. The reversing valve 16 has a first valve opening 21 and a second valve opening 22. The first valve opening 21 connects the supply line 18 to the fuel container. The second valve opening 22 makes it possible for supplemental fluid from a supplemental fluid container 23 to be stored in the pressure chamber 11 of the binary injection nozzle 12 with the aid of a delivery pump 24. A connecting line 25 is thereby continuously connected to a supplemental fluid line 26. A fuel supply line 27, on the other hand, is separated from the fuel line 28. The fuel line 28 can supply fuel from a common rail pressure reservoir 29. The pressure regulator 30 and filter 31 assure a controlled and defined delivery of supplemental fluid from the supplemental fluid container 23.

The actual engine is only schematically indicated in the FIG. 1 and is labeled with the reference numeral 32.

Figure 2:
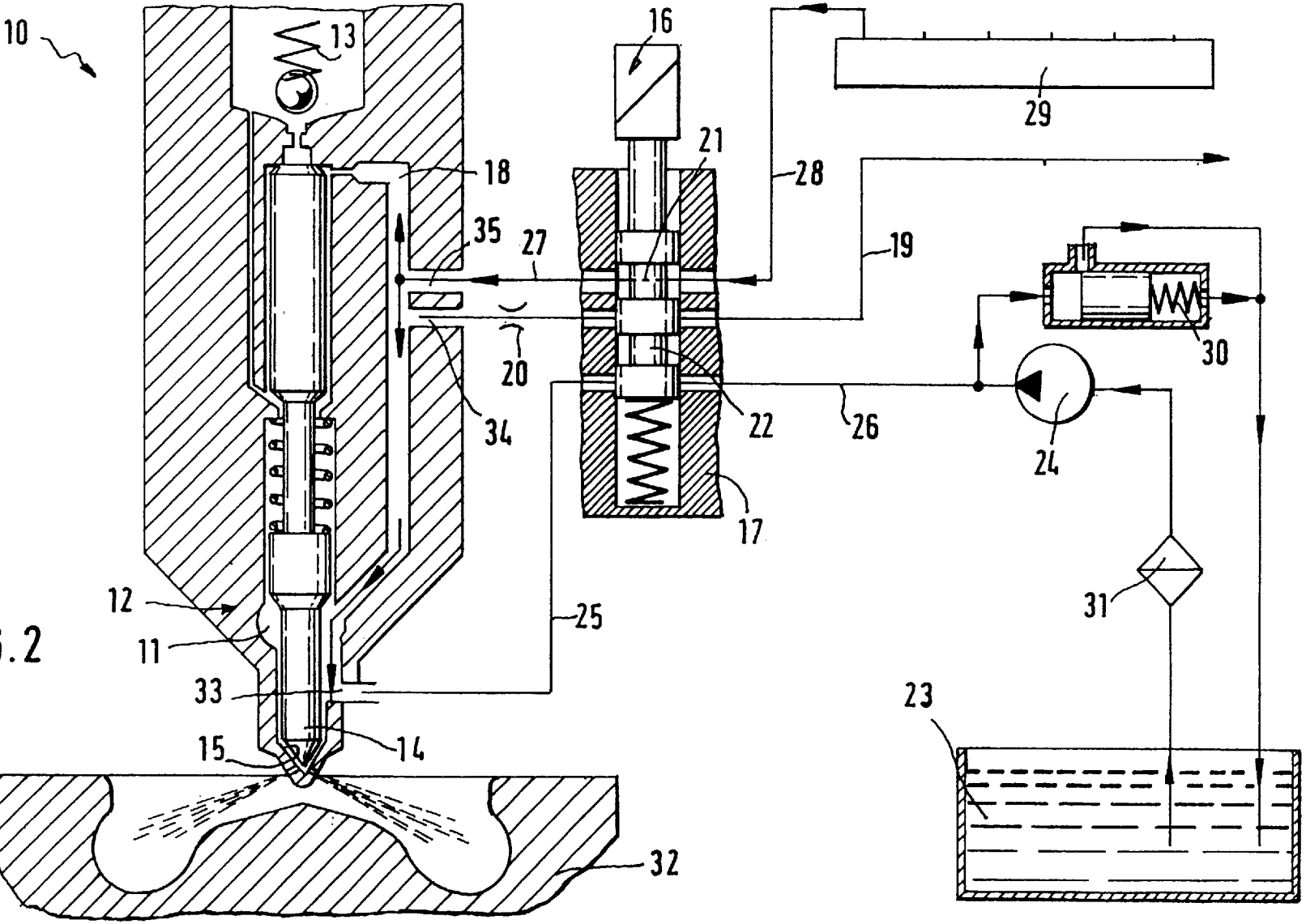

According to FIG. 2, the fuel injection system with an injector 10 is disposed in a state in which fuel and stored supplemental fluid are injected by the binary injection nozzle 12 from the pressure chamber 11 into a combustion chamber of the engine 32.

In FIG. 2 in turn, the engine 32 is only indicated and represented via a portion of its intake region.

By actuating the solenoid valve 13, the nozzle needle 14 is moved away from the valve seat 15. The supply line 18 is connected to the fuel line 28 by way of the fuel supply line 27.

As a result of the position of the reversing valve 16, the first valve opening 21 unblocks the access to the common rail pressure reservoir 29. In contrast, the return line 19 is separated from the supply line 18 by means of the valve position of the reversing valve 16. The supplemental fluid line 25 also has no passage to the supplemental fluid line 26. Consequently, no supplemental fluid from the supplemental fluid container 23 can get into the pressure chamber 11.

By means of the arrangement of bore openings 33, 34, and 35, fuel and supplemental fluid are stored in the pressure chamber "in layers". After the fuel delivery is switched off and during the storage of supplemental fluid in the pressure chamber 11, a residue of fuel remains underneath the bore opening 33. The incoming supplemental fluid settles down on top of it. As a result, a residue of fuel is always injected first.

The foregoing relates to preferred exemplary embodiments of the invention, it being understood that other variants and embodiments thereof are possible within the spirit and scope of the invention, the latter being defined by the appended claims.

I claim:

1. A fuel injection system for an internal combustion engine, provided with a binary injection nozzle (12) connected to a pressure chamber (11) which can be alternatingly supplied with fuel and a supplemental fluid, and further provided with a valve device for controlling both a high-pressure side fuel delivery to the binary injection nozzle (12) and a connection of the pressure chamber (11) to a low-pressure side and to a supply line (26) of the supplemental fluid, the improvement comprising the valve device has a reversing valve (16) provided for controlling impingement of selected pressure levels on the pressure chamber (11) and also for controlling a filling of the pressure chamber (11) with the supplemental fluid.

2. The fuel injection system according to claim 1, in which the reversing valve (16) is a 2/2-solenoid valve.

3. The fuel injection system according to claim 1, in which the reversing valve (16) is built into a high-pressure fuel connection between a common rail pressure reservoir (29) and the pressure chamber (11).

4. The fuel injection system according to claim 2, in which the reversing valve (16) is built into a high-pressure fuel connection between a common rail pressure reservoir (29) and the pressure chamber (11).

5. The fuel injection system according to claim 1, wherein said selected pressure level is low pressure.

6. The fuel injection system according to claim 1, wherein said selected pressure level is high pressure.

* * * * *